US005743667A

United States Patent [19]

Osborne et al.

[11] Patent Number: 5,743,667

[45] Date of Patent: Apr. 28, 1998

[54] FLUID APPLICATOR APPARATUS

[76] Inventors: Michael E. Osborne, 8440 NE. 138th St., Kirkland, Wash. 98034; John R. Anderson, 21520 E. Lost Lake Rd., Snohomish, Wash. 98290

[21] Appl. No.: 295,140

[22] Filed: Aug. 24, 1994

[51] Int. Cl.[6] ..... B05C 17/00

[52] U.S. Cl. ..... 401/9; 401/10; 401/263; 401/281

[58] Field of Search ..... 401/9, 10, 281, 401/263

[56] References Cited

U.S. PATENT DOCUMENTS

| | | | |
|---|---|---|---|
| 1,112,193 | 9/1914 | Carleton et al. | 401/281 |
| 2,702,396 | 2/1955 | Straszer | 401/281 |
| 2,810,145 | 8/1957 | Forrow | 15/121.2 |
| 3,765,983 | 10/1973 | Putzier | 156/293.5 |
| 3,889,628 | 6/1975 | Usab | 401/9 X |
| 4,225,253 | 9/1980 | Fraleigh | 401/9 |
| 4,466,452 | 8/1984 | Ferrari | 132/75 |
| 4,932,801 | 6/1990 | Osborne | 401/11 |
| 5,222,821 | 6/1993 | Osborne et al. | 401/9 |

FOREIGN PATENT DOCUMENTS

| | | | |
|---|---|---|---|
| 534304 | 9/1931 | Germany | 401/281 |
| 849972 | 9/1952 | Germany | 401/281 |

*Primary Examiner*—Steven A. Bratlie

[57] ABSTRACT

An improved fluid applicator apparatus for coating the ends of pipes, studs, bolts, dowels, drill steel and other cylindrical stock having different diameters; wherein, the apparatus comprises two nested apertured cup members captively engaged between a retaining ring member and a viscous fluid filled receptacle member; wherein the retaining ring member is releasably attached to the collar member; wherein the apertures of the cup members are angularly opposed, and, wherein the cup members may be readily rotated with respect to one another in order to adjust the degree of registry of the apertures.

14 Claims, 4 Drawing Sheets

FLUID APPLICATOR APPARATUS

TECHNICAL FIELD

The present invention relates to coating and applicator devices in general, and in particular to an applicator for applying materials to the threads of pipes and the ends of bolts, dowels, and other common round stock of varying diameters.

This patent is an improvement over previously issued U.S. Pat. No. 4,932,801 issued Jun. 12, 1990; and U.S. Pat. No. 5,222,821 entitled "Pipe Dope Applicator Apparatus", issued Jun. 29, 1993.

BACKGROUND ART

As can be seen by reference to the following U.S. Pat. Nos. 4,932,801; 4,466,452; 3,765,983; and 2,810,145; the prior art is replete with myriad and diverse applicators for applying liquid coating to different substrates.

While all of the aforementioned prior art constructions are more than adequate for the basic purpose and function for which they have been specifically designed, these prior art lubricators are in most instances unsuitable for the environment of the present invention in that they are unable to selectively apply material to the upper or lower threads of a pipe; accommodate different sizes of pipe; and, are designed for applying relatively non-viscous liquids. These constructions are also usually inefficient at best when confronted with extremely thick, non-free flowing material; or when confronted with coating studs and bolts, or smooth tubing and fittings of copper or plastic.

As a consequence of the foregoing situation, there has existed a longstanding need for a viscous and non-viscous fluid applicator apparatus which facilitates the application of viscous and non-viscous fluids to the cylindrical ends of various size pipes, studs, tubing and bolts wherein the workman can manipulate the item to be coated and/or the applicator to quickly and uniformly coat the necessary surface area prior to joining sections together; and, the provision of such a construction is a stated objective of the present invention.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

DISCLOSURE OF THE INVENTION

Briefly stated, the applicator system for viscous and non-viscous fluids such as lubricants, sealants and adhesives that forms the basis of the present invention was developed to control and meter the application of a viscous and non-viscous fluid from a supply receptacle containing the fluid onto pipe, studs, bolts, dowels and other cylindrical stock.

An object of the present invention is to accommodate a variety of different stock diameters quickly and efficiently.

Another object of the invention is to readily accommodate the application of liquid in a circumferencial band variably disposed from the end of a pipe.

The applicator system comprises in general a receptacle unit, a metering cup unit, and a retaining ring unit.

The metering cup unit comprises a multitude of metering cup members whereby each cup member has a different inner diameter to accommodate different sizes of cylindrical stock and the sides of each of the cups are provided with a plurality of elongated metering apertures angled with respect to the longitudinal axis of the individual cups.

Each inner cup member is paired with an outer cup member also provided with metering apertures angled with respect to the inner cup apertures.

The receptacle unit comprises in general a receptacle member containing fluid and further provided with a slotted disk element for receiving the metering cup unit and retaining units.

The retaining unit consists of a retaining ring wherein the retaining ring sealingly locks the metering cups to the receptacle unit.

As will be explained in greater detail further on in the specification, when a workman wishes to apply a liquid to the end of a cylindrical item, all that is necessary is for the individual to secure the appropriate metering cup to the receptacle tube, insert the end of the cylindrical item into the mouth of the metering cup and push gently while rotating the item with respect to the receptacle unit.

BEST MODE FOR CARRYING OUT THE INVENTION

Figure 1:
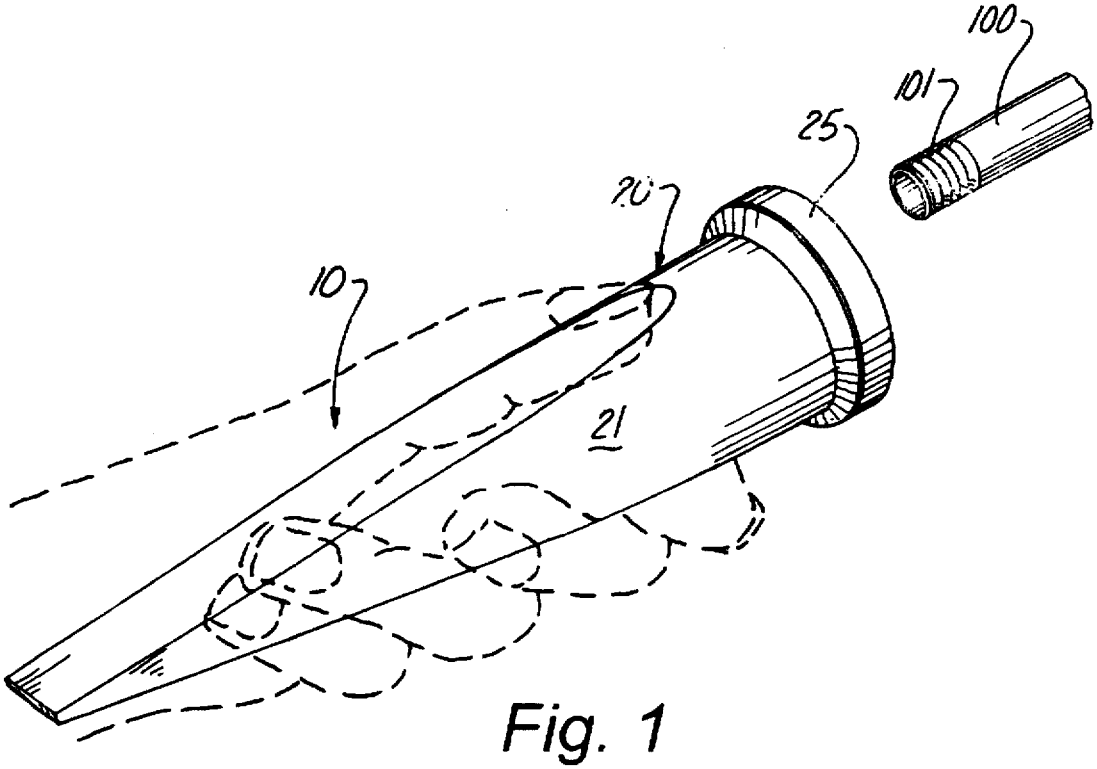
FIG. 1 is a rear perspective view of the applicator apparatus that forms the basis of the present invention.

As can be seen by reference to the drawings, and in particular to FIG. 1. the fluid applicator apparatus that forms the basis of the present invention is designated generally by the reference numeral (10), and is intended for use to apply a generally uniform coating of fluid to the threaded end section (101) of bolts, studs, tubing etc. (100).

Figure 3:
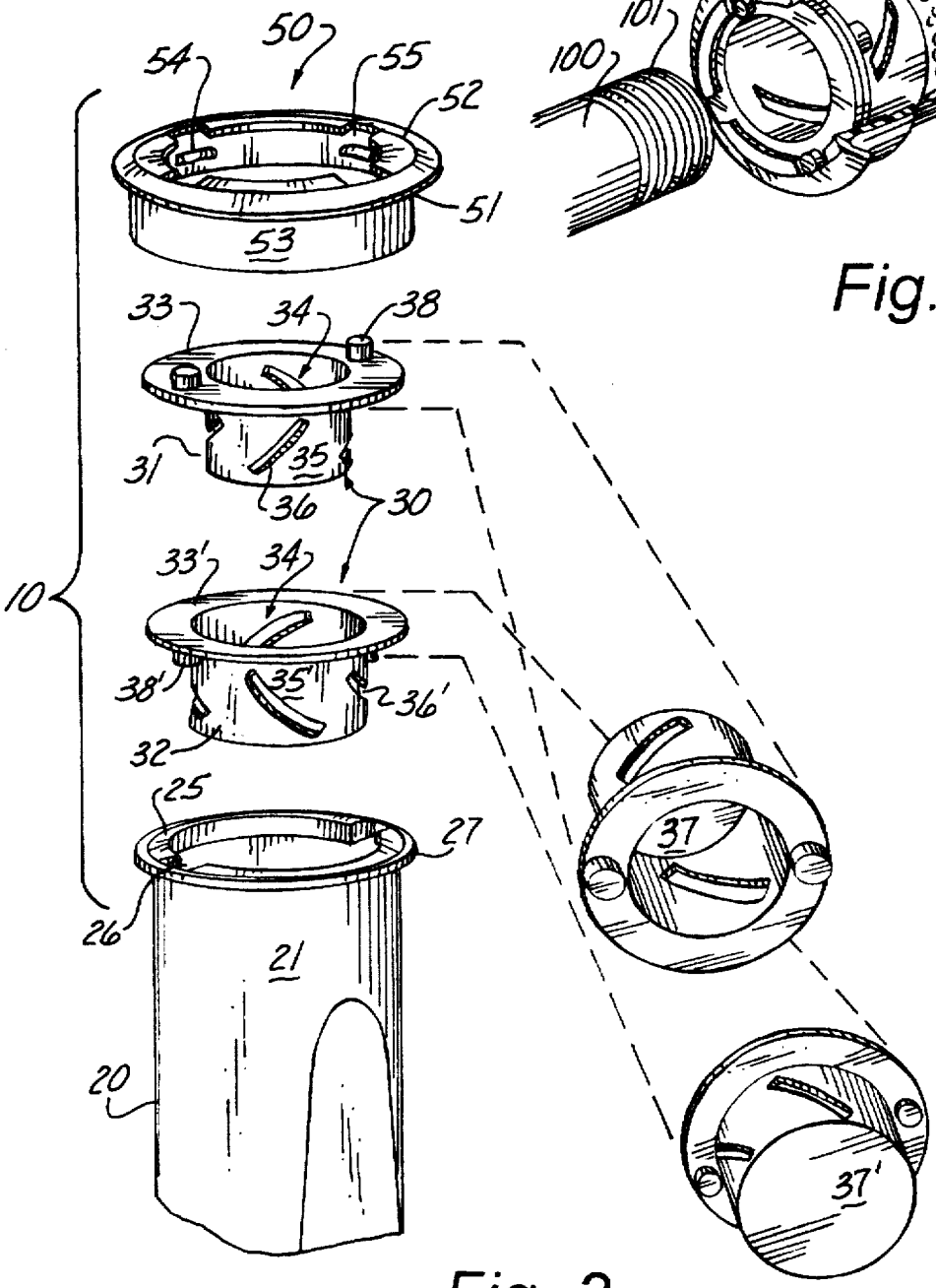
FIG. 3 is an exploded perspective view of a second version of the components of the applicator apparatus.

As shown in FIG. 3, the applicator apparatus (10) comprises in general a receptacle unit (20), a metering cup unit (30), and a retaining ring unit (50). These units will now be described in seriatim fashion.

Figure 4:
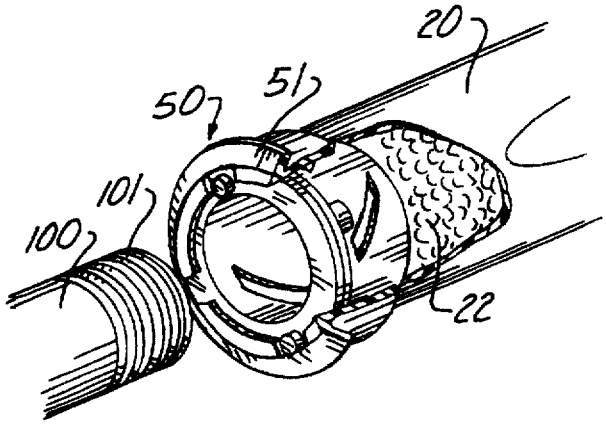
FIG. 4 is a partial cutaway view depicting the insertion of a threaded pipe into the second version of the apparatus.

As can be seen by reference to FIGS. 1, 3, and 4 the receptacle unit (20) comprises an elongated receptacle member (21) containing fluid (22) sealed at one end (24) and having a slotted disk (25) provided on the opposite end. The slotted disk (25) includes a plurality of slots (26) and a collar portion (27) which extends outwardly from the receptacle member (21), whose purpose and function will be described further on in the specification.

As shown in FIG. 3 the metering cup unit (30) comprises an inner metering cup member (31) and an outer metering cup member (32). The metering cup members (31)(32) are provided with uniform diameter lip portion (33)(33') having central openings which define cup mouths (34)(34'). In addition, each of the cup members (31)(32) have downwardly depending cylindrical side walls (35)(35') provided with angled, elongated, apertures (36)(36') spaced around the periphery of the side walls (35)(35') and each of the cup members (31)(32) are provided with sealed bottom portions (37)(37').

Figure 5:
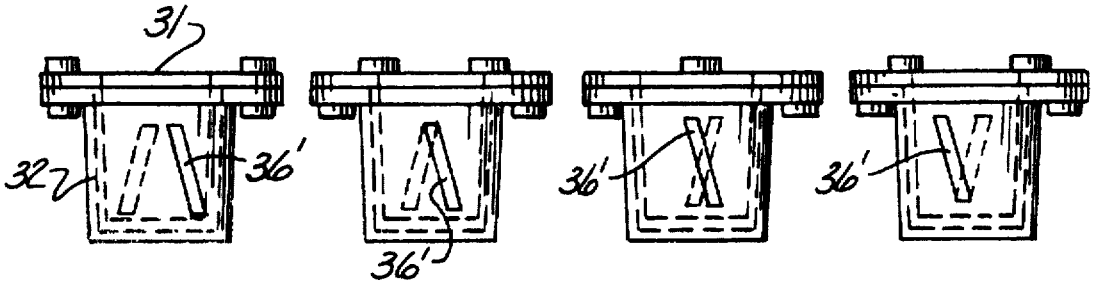
FIG. 5. is a sequential side elevational view of the progressive registry of the apparatus in the rotatable cups.

In addition, as shown in FIG. 5, the angled apertures (36)(36') of each of the metering cup members (31)(32) are angularly offset relative to one another.

Furthermore, the mouth (34) of the inner cup member (31) is dimensioned to loosely receive the ends (101) of threaded pipes, having various diameters. In addition, inner cup members (not shown) may be provided which are dimensioned for closer tolerances with various diameter pipes (100). The lip portion (33) of the inner cup member includes spaced, upwardly extending locking pins (38) for cooperating with the retaining ring unit (50) which will be discussed presently.

Still referring to FIG. 3, it can be seen that the outer cup member (32) is dimensioned to receive the inner cup (33) member for the purpose of relative rotation thereto. The lip portion (33') of the outer cup member (32) is further provided with downwardly depending spaced locking pins (38') for insertion within the slots (26) of the receptacle unit (20) for preventing relative rotational movement of the outer cup member (32) with respect to the receptacle unit (20).

Turning now to FIG. 5, relative rotation of the inner cup member (31) and the outer cup member (32) will place the apertures in various degrees of registry wherein the common passageway between the apertures will move upwardly or downwardly depending on the direction of rotation, wherein the apertures may also be rotated out of registry to prevent the flow of fluid between the outer and inner cup members.

Referring now to FIGS. 3 and 4, it can be seen that the retaining unit (50) includes a retaining member (51) which is provided with a shoulder (52) and reduced diameter downwardly depending skirt (53) having a plurality of detents (54) formed on the interior.

As can be seen particularly by reference to FIG. 4, each of the outer edges of the lip portions (33)(33') of the cup members (31)(32) are dimensioned to be held captive between the retaining unit (50) and the slotted disk (25) of the receptacle unit (20) when the skirt (53) of the retaining unit (21) is snap-fit over the slotted disk (25) of the receptacle unit (20) in a well recognized fashion.

The retaining ring unit (50) is held in place with respect to the receptacle unit (20) by the detents (54) on the interior of the skirt (53), permitting rotation of the retaining ring unit (50) relative to the receptacle unit (20). Furthermore, the top of the retaining ring unit (50) is provided with slots (55) for receiving the locking pins (38) of the inner cup member (31).

As shown in FIGS. 3, 4, and 5, when the apparatus (10) is ready for use, a selected inner cup member (31) and outer cup member (32) are captively engaged between the receptacle unit (20) and the retaining ring unit (50). The locking pins (38) of the inner cup member (31) engage the retaining ring unit (50) via slots (55). Likewise, the locking pins (38') of the outer cup member (32) engage the slots (26) of the slotted disk (25) of the receptacle unit (20). The retaining ring unit (50) is rotated with respect to the receptacle unit (20) such that the angled apertures (36)(36') overlap at the desired height and liquid (22) can flow through these apertures (36)(36') to coat the end (101) of a suitable dimensioned pipe (100). It should be obvious at this point that depending on the size of the pipe (100), different sized cup members (32)(33) can be employed with the receptacle unit (20) and the retaining ring unit (50).

Figure 8:
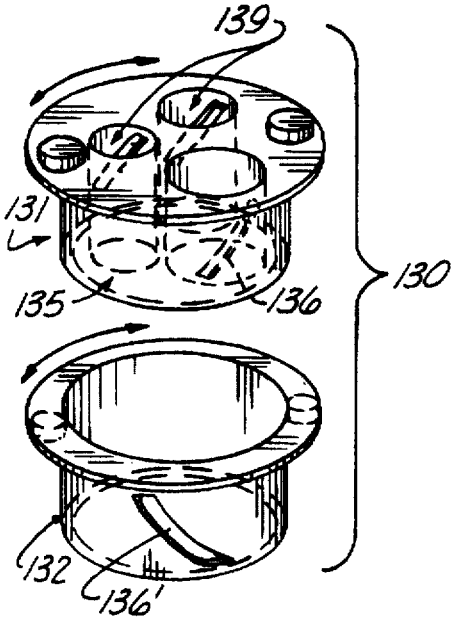
FIG. 8 is an isolated exploded perspective view of a third version of the invention.

In an alternative embodiment shown in FIG. 8, the outer cup member (132) has a single angled aperture (136') while the inner cup member (131) has a plurality of slotted, discrete receptacle elements (139) having different diameters wherein the slot (136) in each of the receptacle elements extends through the adjacent side wall portion (135) of the inner cup member (131). The outer cup member (132) of the alternate embodiment (130) is sized to loosely receive the inner cup member (131) such that the single angled aperture (136') of the outer cup member (132) aligns with at most one aperture (136) of the inner cup member (131). Relative rotation of the inner (131) and outer (132) cup members raises, lowers, or seals off the apertures that supply the fluid contents of the receptacle to the pipe.

Figure 6:
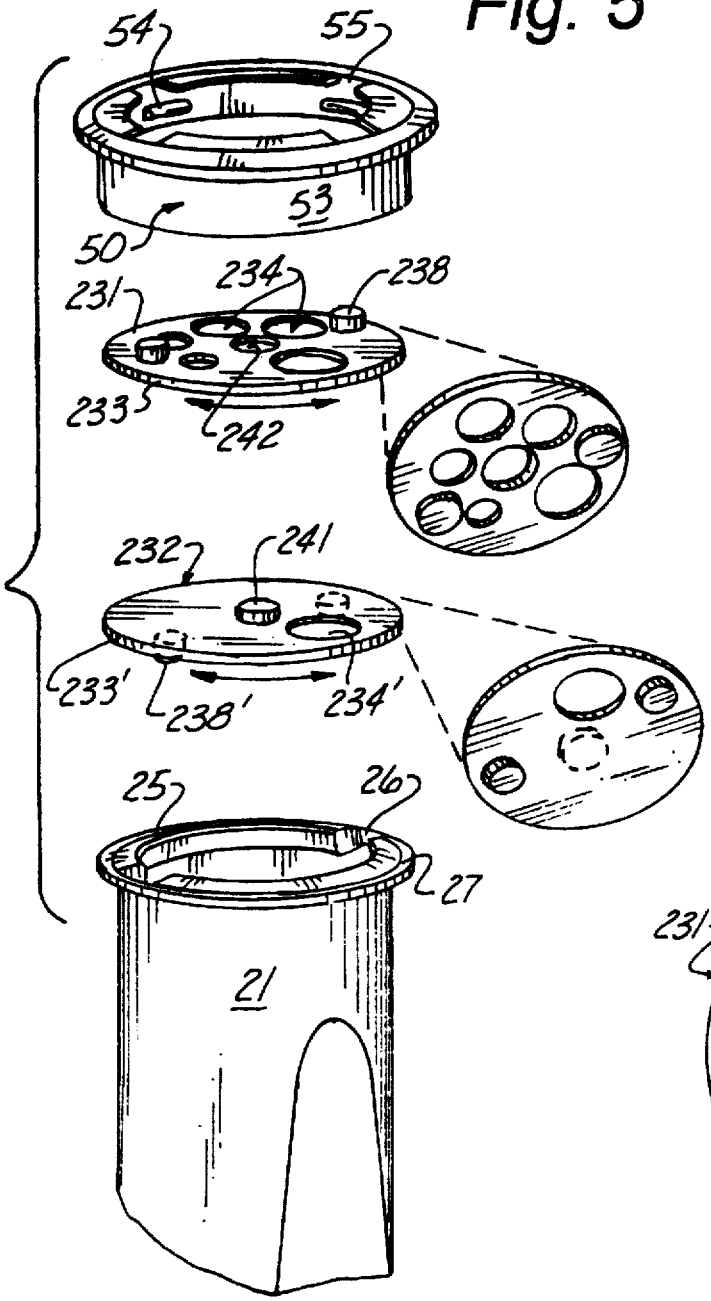
FIG. 6 is an exploded perspective view of the components of the various disks which may be employed in conjunction with the first version of the apparatus.
Figure 7:
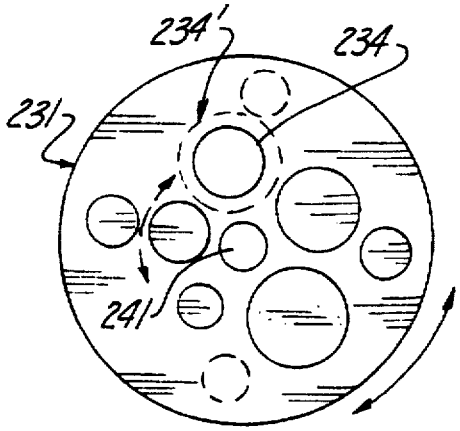
FIG. 7 is an isolated top plan view of the upper applicator disk.

In another alternative embodiment, shown in FIGS. 6 and 7, the cup members are replaced by upper (231) and lower (232) apertured flat cylindrical metering plate members. The lower metering plate member (232) has an outer circumference (233') dimensioned to fit loosely within the skirt (53) of the retaining ring unit (50), and is further provided with downwardly depending locking pins (238'), mouth portion (234'), and an upwardly extending centering peg (241).

Still referring to FIGS. 6 and 7, the upper metering plate member (231) comprises a plurality of different diameter openings (234), a plurality of upwardly extending locking pins (238), and a centering hole (242) for receiving the centering peg (241) of the lower plate member (232).

Figure 2:
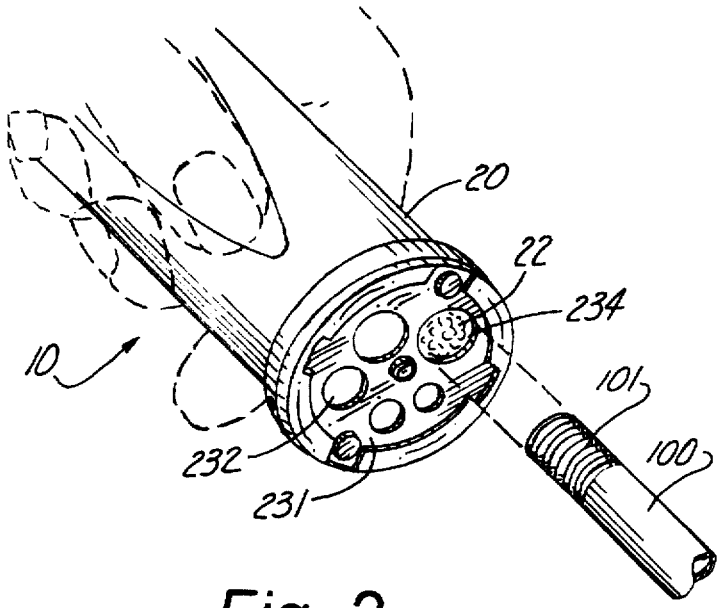
FIG. 2 is a front perspective view of a first version of the applicator apparatus in use.

Referring in particular to FIGS. 2 and 7, the rotation of the upper plate (231) relative to the lower plate (232) aligns the mouth of the lower plate (234') with one of the openings (234) of the upper plate (231) thereby allowing an appropriately dimensioned bolt, stud, or drill steel (100) to be coated with the fluid (22).

Figure 9:
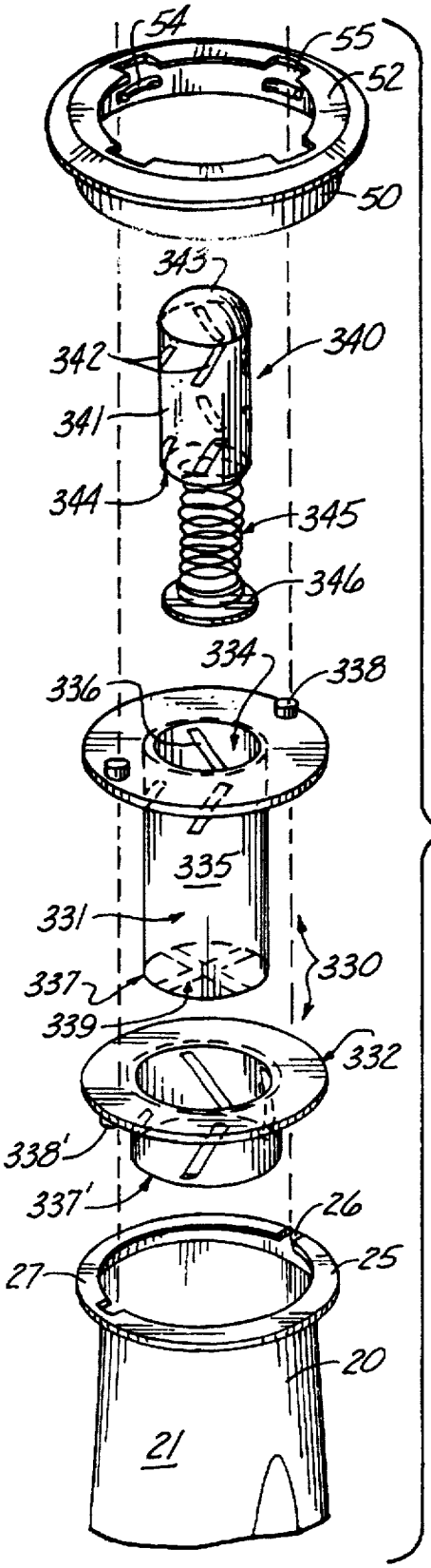
FIG. 9 is an exploded perspective view of a fourth version of the invention.

Turning now to FIG. 9, it can be seen that in the fourth version of the preferred embodiment the metering cup ring unit is designated generally as (330) and is operatively associated with an applicator ring unit (340). These ring units will now be described in seriatim fashion.

A quick comparison of the metering cup ring units depicted in FIGS. 3 and 9 will reveal that they share a great deal of structural similarities with the following notable exceptions. First of all in the embodiment shown in FIG. 9 the inner (331) and outer (332) cup members each have an open bottom (337) and (337') respectively. In addition the inner cup member (331) is further provided with elongated sidewalls (335) and a cruciform stop member (339) disposed across the open bottom (337). The purpose and function of these structural differences will be explained in greater detail presently.

Still referring to FIG. 9 it can be seen that the applicator ring unit (340) comprises an elongated generally cylindrical applicator body member (341) having a plurality of angled apertures (342) formed therein; wherein, the top (343) of the applicator body member (341) is rounded and the bottom (344) of the applicator body member (341) is open.

In addition the applicator ring unit (340) further includes a spring biasing element (345) dimensioned to be received within the applicator body member (341); wherein, the bottom of the spring biasing element (345) is provided with a discrete base element (346) which is dimensioned to be received within the mouth (334) of the inner cup member (331) and rest upon the stop member (339) such that an open fluid passageway is maintained through the inner cup member (331).

In this particular embodiment of the invention, when it is desired to coat the exterior of a hollow cylindrical item such as a pipe, the pipe is used to depress the top (343) of the applicator body member (341) into a recessed disposition relative to the inner cup member (331); such that fluid can flow through the apertures (336) onto the exterior of the pipe.

In those instances, wherein it is desired to coat the interior surface of a fitting, ie., elbow, coupling, 45% elbow, tee, etc. the top (343) of the applicator body member (341) is inserted into the interior of the fitting and the flexible walls of the receptacle member (21) are depressed to force the fluid through the open ends (337) and (337') of the inner (331) and outer (332) cup members into the interior of the applicator body member (341) and through the apertures (342) onto the interior walls of the fitting.

Having thereby described the subject matter of the present invention, it should be apparent that many substitutions, modifications, and variations of the invention are possible in light of the above teachings. It is therefore to be understood that the invention taught and described herein is only to be limited to the extent of the breadth and scope of the appended claims.

We claim:

1. An improved applicator for dispensing liquid onto the ends of generally cylindrical workpieces; wherein, the apparatus comprises:

a receptacle unit including an open ended receptacle member forming a reservoir for a supply of liquid;

a metering ring unit including two metering cup members deployed on the open end of the receptacle member; wherein, the metering cup members are relatively rotatable relative to one another, and each one of the metering cup members are provided with at least one angled aperture which is selectively registrable with at least one cooperating angled aperture on the other metering c member to permit passage of the liquid from the receptacle member through the angled aperture in the metering cup members to vary the volume and point of introduction of the liquid passing thru the metering cup members.

2. The applicator apparatus as in claim 1, further including:

a retaining means for captively engaging the metering ring unit to the receptacle unit while permitting the relative rotation of the two metering cup members with respect to one another.

3. The applicator apparatus as in claim 2; wherein, the metering ring unit comprises:

an inner metering cup member and an outer metering cup member; wherein, each of the metering cup members is provided with generally cylindrical apertured sidewalls and a closed bottom portion.

4. The applicator apparatus as in claim 3; wherein, the inner metering cup member is operatively associated with said retaining means and dimensioned to be loosely received within the outer metering cup member; wherein the outer metering cup member is operatively associated with said receptacle unit.

5. The application apparatus as in claim 4; wherein at least one angled aperture on each of the metering cup members are angularly disposed relative to one another.

6. The applicator apparatus as in claim 4; wherein, both the inner and outer metering cup members are provided with a plurality of angled apertures, and the angled apertures on one of the metering cup members are angularly disposed relative to the angled apertures on the other of the metering cup members.

7. The applicator apparatus as in claim 2; wherein, the metering ring unit comprises an upper apertured metering plate and a lower apertured metering plate mounted for relative rotation with respect to one another on the open end of the receptacle member; wherein, the lower metering plate is provided with at least one aperture which is selectively registrable with all the apertures on the upper metering plate.

8. The applicator apparatus as in claim 5; wherein the inner metering cup member is provided with a plurality of discrete apertured receptacle elements.

9. The applicator apparatus as in claim 8; wherein, each of the receptacle elements has a different diameter.

10. The applicator apparatus as in claim 8; wherein, each of the receptacle elements is provided with a single angled aperture that communicates with the outer wall of the inner metering cup member.

11. The applicator apparatus as in claim 2; wherein the metering ring unit comprises:

an inner metering cup member and an outer metering cup member; wherein, each of the metering cup members is provided with a generally cylindrical apertured sidewalls and an open bottom.

12. The applicator apparatus as in claim 11 further comprising:

an applicator ring unit including a spring biased applicator body member operatively disposed within said inner cup member; wherein, the applicator body member is provided with a plurality of apertures for dispensing liquid.

13. The applicator apparatus as in claim 12; wherein the top of said spring biased applicator body member is normally disposed above the top of said inner cup member.

14. The applicator apparatus as in claim 13; wherein, the top of said spring biased applicator body member may be forceably depressed into the interior of said inner cup member.

* * * * *